US005488548A

United States Patent [19]

Kwong

[11] Patent Number: 5,488,548

[45] Date of Patent: Jan. 30, 1996

[54] MODULAR LIGHTING FIXTURE

[76] Inventor: Allan H. C. Kwong, 11 Wang Chiu Road, Kowloon Bay, Kowloon, Hong Kong

[21] Appl. No.: 161,914

[22] Filed: Dec. 3, 1993

[51] Int. Cl.[6] ..... F21V 21/02

[52] U.S. Cl. ..... 362/249; 362/147; 362/238; 362/252

[58] Field of Search ..... 362/147, 238, 362/249, 252, 368, 219, 362, 225

[56] References Cited

U.S. PATENT DOCUMENTS 4,368,506 1/1983 Rapp ..... 362/147

4,385,346 5/1983 Spicer ..... 362/147

4,532,579 7/1985 Merryman ..... 362/457

*Primary Examiner*—Ira S. Lazarus

*Assistant Examiner*—L. Heyman

*Attorney, Agent, or Firm*—Kennedy & Kennedy

[57] ABSTRACT

A lighting fixture comprising at least a pair of modules each having at least one light source. The modules are positioned spaced-apart on a wall or ceiling to define a gap between the modules. A tubular connector joins the modules together. A cap covers the gap to provide a finished, uniform appearance for the fixture. The electrical conductors for the light in one module extends through the connector into the adjacent module. The electrical conductors extend across the gap into the adjacent module for connecting with a source of electrical current.

11 Claims, 3 Drawing Sheets

MODULAR LIGHTING FIXTURE

TECHNICAL FIELD

The present invention relates to lighting fixtures. More particularly, the present invention relates to a lighting fixture selectively assembled from spaced-apart modules with a cap concealing a gap between adjacent modules.

BACKGROUND

Lighting fixtures for walls or ceilings typically have a backplate that attaches to a support in the wall or ceiling. The support typically is an electrical junction box that is nailed to a stud. The stud is part of the frame for the wall or ceiling. A faceplate connects to the backplate. At least one socket for receiving a light bulb connects to the light fixture. Often the socket attaches to the backplate; in other fixtures, the socket attaches to an ornamental stem or tube that bolts to the faceplate.

Typical light fixtures for use with vanity sinks in bathrooms have one, two, three, or four light sockets. The length of the light fixture varies depending on the number of light sockets in the fixture. The available space for installing a light fixture is measured, and the appropriate fixture is selected for installation.

For ornamental effect and to accommodate differing physical layouts, it would be desirable to group several of the light fixtures together, such as being placed side-by-side or stacked. For example, a four-light fixture may be assembled by positioning four one-light fixtures side-by-side or by positioning two two-light fixtures together. Other sites may require stacking two or more fixtures together to satisfy the needs for an ornamental appearance or provide appropriate lighting for a site. Such assemblies of side-by-side and/or stacked fixtures however leave gaps between the adjacent fixtures. Also, the routing of electrical wires for the light sockets is more difficult. Wires must be placed under or around backplates for gathering together in order to connect with a source of electricity. Electrical wires can be seen in the gaps, which detracts from the overall appearance of the design for the custom light fixture.

Accordingly, there is a need in the art for an improved lighting fixture for mounting on walls and ceilings.

SUMMARY

The present invention meets the need in the art for improved wall lighting fixtures. Generally described, the present invention comprises a lighting fixture made of space-apart modules with a cap that engages the adjacent modules and covers a gap through which a pair of electrical conductors extend between the modules.

More particularly described, the present invention comprises at least two spaced-apart wall lighting fixtures that secure to a wall or ceiling surface. Each lighting fixture is a module comprising a faceplate having a face with flanges extending laterally from the edges of the face. At least two opposing flanges each include a knockout, for selective removal to form an opening for receiving electrical wires therethrough. A socket for a light bulb attaches to the module. The socket connects to a pair of electrical conductors for communicating with a source of electricity. At least two of the fixture modules secure to a wall or ceiling surface in a spaced-apart relationship that defines a gap. The pair of electrical conductors from one of the fixture modules extends into the other fixture module through the openings defined by removing the facing knockouts in the flanges. A cap covers the gap between the faces to hide the pair of electrical conductors extending between the adjacent fixture modules and to afford a unified appearance to the lighting fixture.

More particularly described, the cap for covering the gap between the adjacent modules comprises a member having a pair of arms. One arm extends laterally from a respective one of the ends of the member. The distal edge of each arm is rolled to define a stop. The member clips on the faceplates of the adjacent wall lighting fixture modules. The stop engages an edge of the faceplate flange to hold the cap in place.

One embodiment includes a backplate that secures with screws to the wall or ceiling. The backplate includes laterally extending flanges for grippingly engaging the faceplate. At least two opposing flanges in the backplate have holes for receiving the pair of electrical conductors therethrough.

A preferred embodiment includes a tubular connector that rigidly joins the two spaced apart modules. Distal ends of the connector insert through the holes in the facing flanges of the adjacent modules. Nuts thread on the ends to secure the connector to the flanges. The connector further provides a tunnel through which the electrical conductors pass from one module to the other for connecting to a supply of electricity.

More particularly described, the present invention comprises at least two spaced-apart wall lighting fixtures that secure to a wall or ceiling surface. Each lighting fixture is a module comprising a faceplate and a backplate, each with laterally extending flanges. The flanges slidingly engage to attach the faceplate to the backplate. At least two opposing flanges in the backplate each include an opening for receiving a threaded distal end of a tubular connector. A nut threads on the end to secure the connector to the flange. Two opposing flanges in the faceplate each include a knockout, for selective removal to form an opening. A socket for a light bulb attaches to the module. The socket connects to a pair of electrical conductors for communicating with a source of electricity.

At least two modules join together by attaching at least one of the connectors between the aligned openings in the adjacent backplate flanges. This defines a gap between the modules. The modules secure to a wall or ceiling surface and the pair of electrical conductors from one of the fixture modules passes into the other fixture module through the tubular connector. The faceplate attaches to the backplate. The openings defined by removing the facing knockouts in the flanges slidingly receive the connector. A cap covers the gap between the faces to hide the connector between the adjacent fixture modules and to afford a unified appearance to the lighting fixture.

A method of assembling a wall lighting fixture is also provided. Generally, the method comprises securing at lest two modular lighting fixtures to a wall or ceiling surface in a spaced-apart relationship, thereby defining a gap between the fixtures. Electrical conductors from one of the fixture modules extends into the other fixture module through the gap for making electrical connection with a source of electricity. A cap positioned on the fixtures covers the gap and provides a unified appearance for the lighting fixture made of modules.

More particularly described, the invention provides a method of assembling alighting fixture from modules. At least two modules secure together in a spaced-apart relationship by connecting a tubular connector to openings in facing flanges of a backplate in each module. The connector between the joined backplates defines a gap. The backplates attach to a wall or ceiling surface. Electrical conductors from one of the fixture modules extends into the other fixture module through the connector for making electrical connection with a source of electricity. A cap positioned on the fixtures covers the gap and provides a unified appearance for the lighting fixture made of modules.

The features and advantages of the present invention will become apparent from a reading of the following specification, in conjunction with the drawings and appended claims.

DETAILED DESCRIPTION

Figure 1:
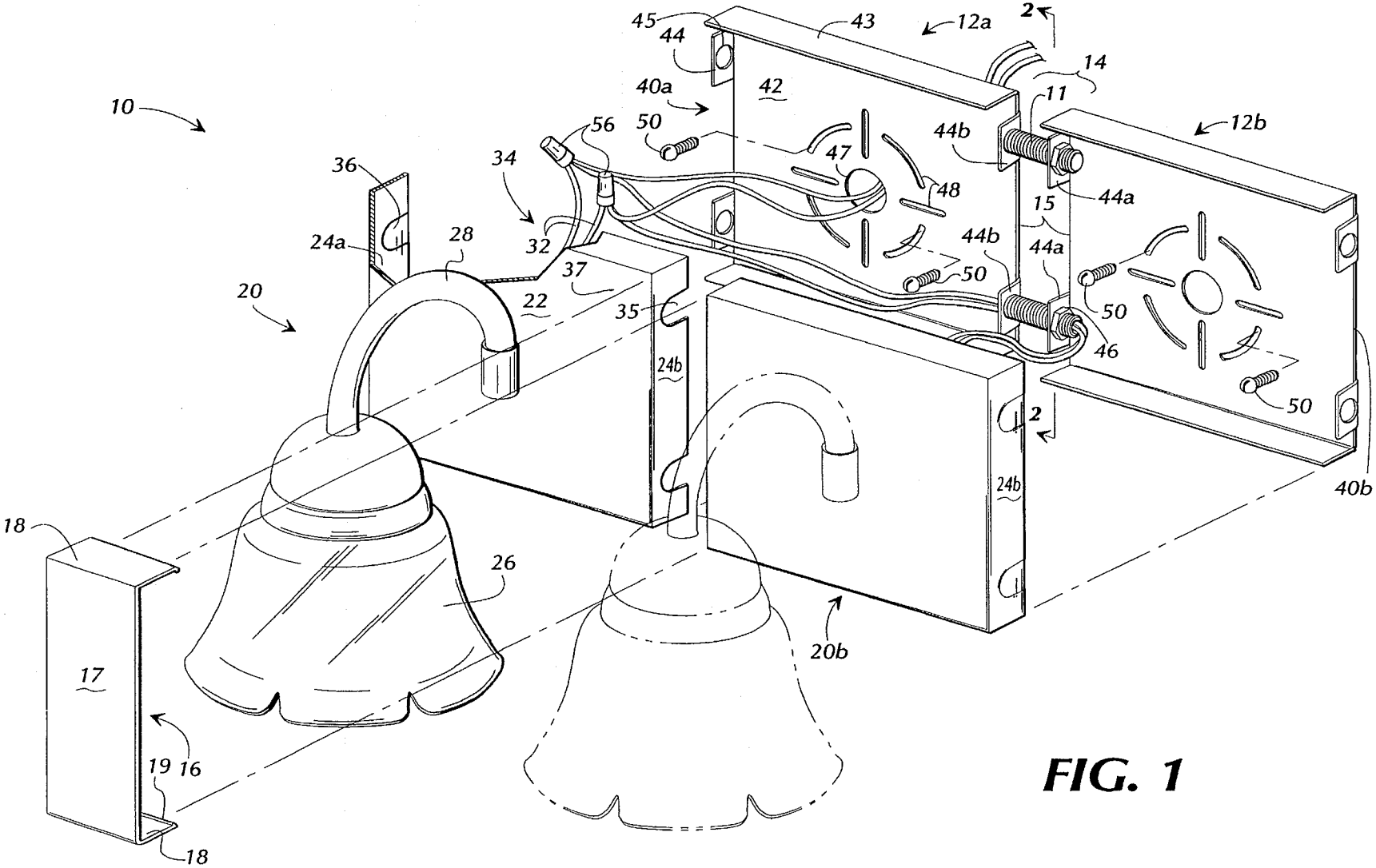
FIG. 1 is a perspective exploded view of a modular wall lighting fixture according to the present invention.

Referring now in more detail to the drawings, in which like numerals indicate like parts throughout the several views, FIG. 1 shows a perspective exploded view of a lighting fixture 10 assembled from two interconnected spaced-apart modules 12. The modules 12 connect together with a threaded stem 11, as discussed below. The stem 11 preferably is a tubular connector having threaded distal ends. The spacing of the modules 12 creates a gap 14 between adjacent edges 15 of the modules 12. A cap 16 covers the gap 14 and affords a unified appearance to the lighting fixture 10. The cap 16 comprises an elongated member 17 having a pair of arms 18 that extend laterally. Each arm 18 has a distal end that is rolled to form a stop 19, for a purpose discussed below.

Each module 12 includes a faceplate 20 having a face 22 with flanges 24 extending laterally from the edges of the face. The flanges 24 define the sides of the module 12. In the illustrated embodiment, a light socket and globe 26 attaches to a distal end of a curved tube 28 rigidly connected to the faceplate 20. The socket 26 receives a light emitting bulb (not illustrated). The socket 26 connects to a pair of electrical conductors 32. The electrical conductors thread through the tube 28 and into the interior space 34 defined by the face 22 and the flanges 24.

At least two opposing flanges 24*a* and 24*b* each include an embossed knockout 36. The knockout 36 is defined by a shallow groove in the flange. The knockout 36 is selectively removed to form a notch opening 35 for receiving the threaded stem 11. In the illustrated embodiment the notch opening 35 is U-shaped for conformingly receiving the cylindrical stem 11, as discussed below. A portion 37 of the face 22 near the side 15 receives the cap 16 which bridges the gap 14 between the adjacent modules 12. The cap 16 overlaps the edge portion 37.

The illustrated embodiment includes a backplate 40 comprising a panel 42 with flanges 43 and side flanges 44 that extend laterally at the edges. The flanges 44 each have an opening 45 which receives a threaded end of the stem 11. A nut 46 threads on the end of the stem 11 on the interior side of the flange 44. The panel 42 includes a central opening 47 with a series of openings 48 concentrically disposed around the opening 47. A pair of screws 50 extend through two of the openings 47 for securing the backplate to a surface, such as a wall or ceiling. A pair of electrical conductors 54 connect with a source of electricity (not illustrated). The electrical conductors 54 enter the module through the opening 47, as discussed below. A wire cap 56 connects mating wires 32 and conductors 56.

Figure 2:
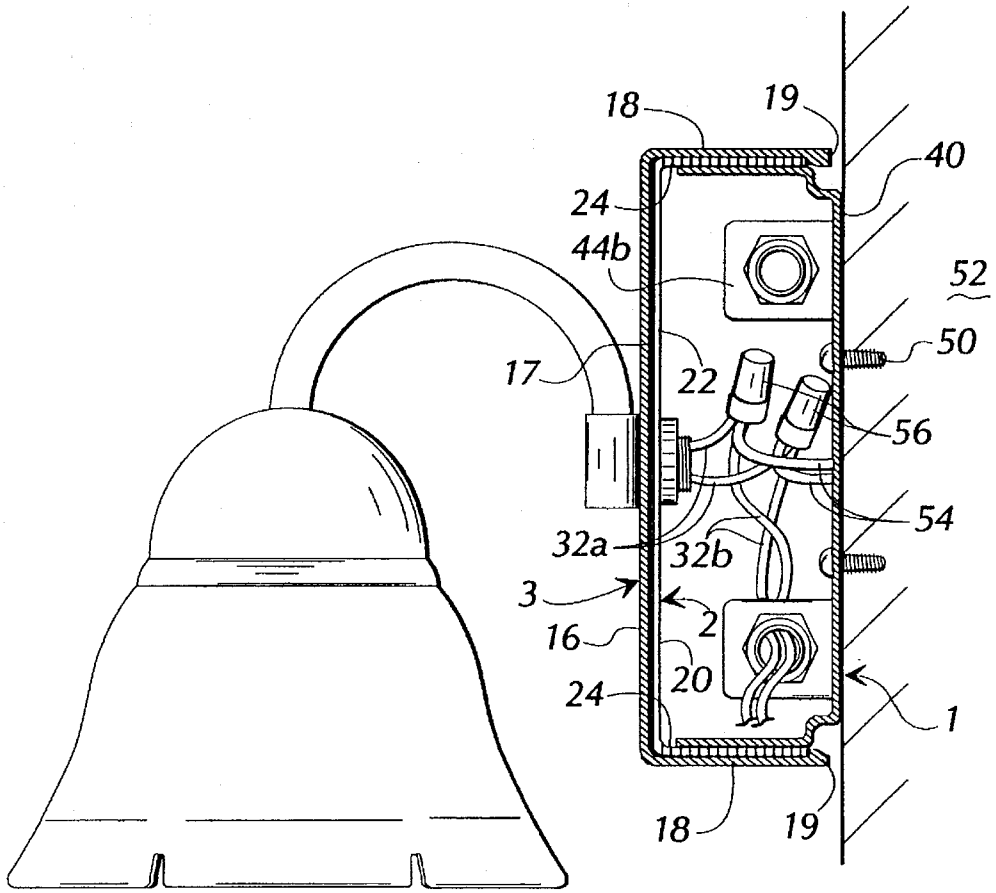
FIG. 2 is a side cut-away view of the modular wall lighting fixture taken along the line 2—2 of FIG. 1.

FIG. 2 is a side view of the assembled modular wall lighting fixture 10 taken along line 2—2 of FIG. 1 discussed above, illustrating details of the fixture 10. The screws 50 connect the backplate 40 to a surface 52, such as a wall or ceiling. In a preferred embodiment, at least one of the modules connects to an electrical junction box (not illustrated). The electrical conductors 32*a* from the module 12*a* connect with the electrical conductors 32*b* from the module 12*b* and with the electrical conductors 54. The electrical conductors 32*b* pass through one of the threaded stems 11 connecting the modules 12 together. The electrical conductors 54 enter the lighting fixture 10 through the opening 46 in the backplate 20. The wire caps 56 secure the electrical conductors 32 and 54 in electrical communication with the source of electricity. The faceplate 20 slidingly engages the backplate 40. The flanges 24 contact the flanges 43 and 44 of the backplate. The cap 16 is slidingly received on the edge portions 37 of the spaced-apart modules 12. The stop 19 catches on the edge of the respective flange 24 to secure the cap 16 in place.

The cap 16 preferably is manufactured of a elongated metal strip folded to define the arms 18. The ends of the arms are rolled or bent over to form the stop 19. In an alternate embodiment, the cap 16 is formed of plastic material.

The lighting fixture 10 assembles by securing at least two of the modules 12 in a spaced-apart relationship on a wall or ceiling surface 52, as illustrated in FIGS. 1 and 2. Preferably, at least two backplates 40 are first secured together by engaging the ends of the threaded stems 11 with the respective openings 45 of the flanges 44 facing each other across the gap 14. Nuts 46 secure the stem 11 between the facing flange 44*b* of the modules 12*b* and 12*a*, respectively. The backplates 40 are then placed in position on a wall or ceiling surface 52 using the screws 50 that extend through two of the openings 48 in each backplate. The openings 48 preferably are punched keyholes. These comprise a flap punched in the backplate 40 with a tab connecting the flap to the plate 42. The holes are formed by bending the flap outwardly on the tab. The holes 48 are spaced for aligning with the spacing of the mounting holes in a conventional electrical junction box (not illustrated). The electrical wires 54 from the electrical junction box connect to a source of electricity. The wires 54 insert through the opening 47 into the space defined by the plate 42 and the flanges 43 and 44 of the backplate 40.

The faceplates 20 for the modules 12 are prepared for installation. The appropriate keyholes 36 on the faceplates 20 are opened. This is accomplished by pushing or forcing the embossed key 36 through the wall of the flange 24 to create the opening. For the module 12*b* on the right side of the fixture 10, the keys 36 in the flange 24*a* are opened. For the module 12*a* on the left side of the fixture 10, the key 36 in the flange 24*b* is opened.

The electrical conductors 32*b* thread from the module 12*b* into the module 12*a*. The electrical conductors pass through one of the threaded stems 11 that connects the two backplates 40 together. The stem 11 provides a tunnel across the gap 14 through which the electrical conductors 32*b* pass from the module 12*b* into the module 12*a*. The electrical conductors 32*b* join the electrical conductors 32*a* in the module 12*a* with the electric wires 54 that connect to the supply of electricity. The wire caps 56 or the like secure the conductors 32 and wires 54 in electrical communication.

The faceplates 20 are then installed on the backplates 40. In the illustrated embodiment, the faceplates 20 are pushed onto the backplates 40 so that the flanges 24 overlap the flanges 43 and 44 of the backplates. The flanges 24, 43 and 44 slidingly engage to hold the faceplate 20 to the backplate 40. The openings 35 slidingly receive the threaded stem 11 adjacent the flanges 44*b* of the backplate 40*a*. The shape of the openings 35 conform to the stem 11. In an alternate embodiment (not illustrated) screws extend through holes in the flanges 24 and 44 to secure the faceplates and backplates together. In another alternate embodiment, the socket 26 mounts to the backplate 40. The socket extends through a hole in the faceplate 22. An open-ended cup is received on the socket. The cup has several inwardly extending barbs that grippingly engage the socket for further holding the faceplate to the backplate.

The faceplate 20 for the second module 12*b* is similarly installed by engaging the flanges 24 with the flanges 43 and 44. The openings 35 slidingly engage the stem 11 adjacent the flanges 44*a* in the backplate 406. Finally, the gap 14 is closed by snapping the cap 16 onto the adjacent edge portions 37 of the faceplates 20 on the modules 12*a* and 12*b*. The arms 18 extend over the respective upper and lower flanges 24 of the faceplates. As best illustrated in FIG. 2, the stop 19 slips past the distal edge of the flanges 24 and resists removal of the cap 16. The cap 16 provides a visual connection between the modules 12*a* and 12*b* for affording a uniform appearance for the lighting fixture 10.

Figure 3A:
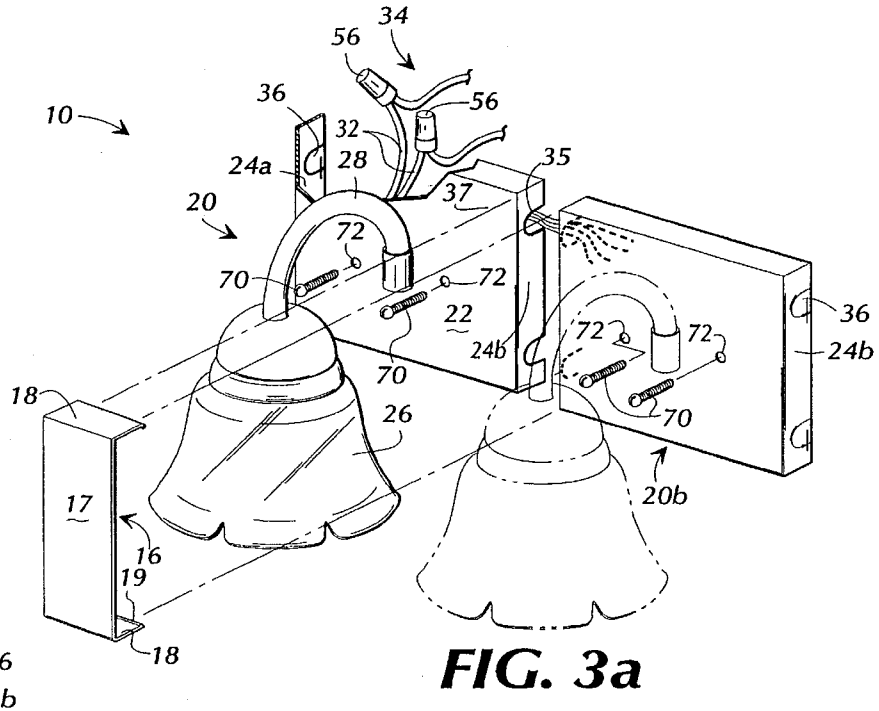
FIG. 3*a* is a perspective view of an alternate embodiment of the modular wall lighting fixture shown in FIG. 1.
Figure 3B:
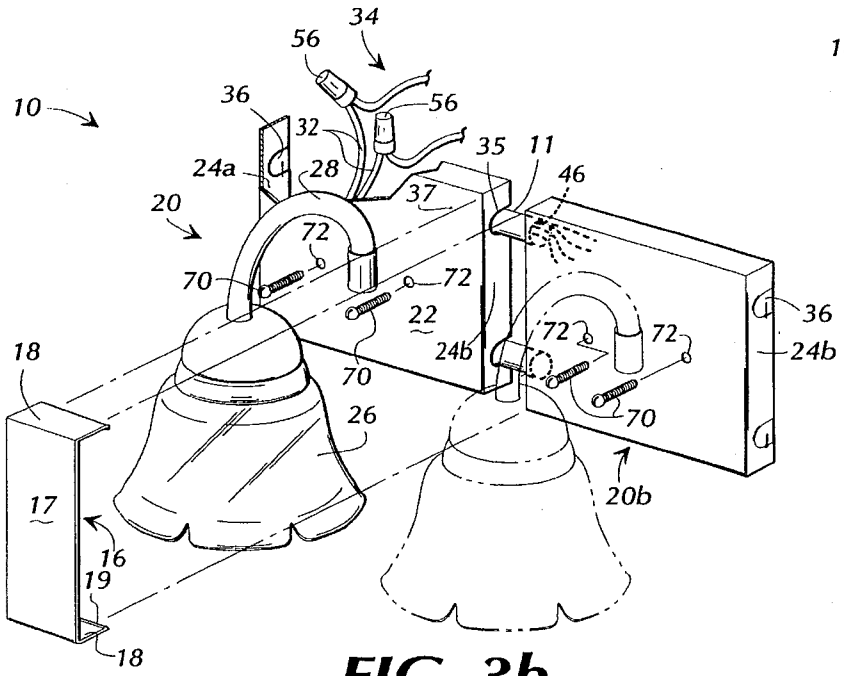
FIG. 3*b* is a perspective view of an alternate embodiment of the modular wall lighting fixture shown in FIG. 1.

FIG. 3*a* illustrates an alternate embodiment of the lighting fixture 10 that does not require use of the backplates 40. The faceplate 20 secures to a wall or ceiling with screws 70 that extend through holes 72 in the face 22. In this embodiment, the knockouts 36 do not extend to the edge of the flange 24. Rather the knockouts 36 form openings, such as the opening 45 in the flange 24. The electrical connectors 32 in one module 12 pass through the knockouts 36 into the other module. FIG. 3*b* illustrates another alternate embodiment does not use the backplate 40. In that embodiment, the openings made by removing the knockouts 36 receive the threaded stem 11 as discussed above for connecting adjacent faceplates 20 together and for providing a closed path through which the electrical conductors 32 pass from one module 12 to the other module. The cap 16 covers the gap 14 between the modules.

The principles, preferred embodiments, and modes of operation of the present invention have been described in the foregoing specification. The invention is not to be construed as limited to the particular forms disclosed because these are regarded as illustrative rather than restrictive. Moreover, variations and changes may be made by those skilled in the art without departing from the spirit of the invention as described by the following claims.

What is claimed is:

1. A modular wall lighting fixture, comprising:

at least two lighting fixture modules, each module comprising:

a faceplate having a face with at least two opposing flanges extending laterally from the edge of the face, each of the two opposing flanges including a knockout for selective removal to form an opening for receiving electrical conductors therethrough;

means for receiving a light bulb that connects with a pair of electrical conductors to a supply of electricity;

said modular wall lighting fixture further comprising means for securing the fixture modules to a surface in a spaced-apart relationship such that at least one pair of adjacent ones of the fixture modules is provided which defines a gap therebetween, with the pair of electrical conductors from a first of the pair of fixture modules extending into a second of the pair of fixture modules through an adjacent pair of openings defined by removing the facing ones of the knockouts in the flanges of the pair of fixture modules; and a cap that covers a gap between the faces of the pair of fixture modules for hiding the pair of electrical conductors extending between the pair of fixture modules.

2. The modular wall lighting fixture as recited in claim 1, wherein means for securing comprises:

the faceplate defining a hole in a face surface; and a screw extending through the hole for securing the module.

3. The modular wall lighting fixture as recited in claim 1, wherein means for securing comprises:

a backplate defining at least one hole therein;

a screw extending through the hole for securing the module to the surface; and means for attaching the faceplate to the backplate.

4. The modular wall lighting fixture as recited in claim 3, wherein means for attaching comprises flanges extending laterally from at least two edges of the backplate which is sized for engaging the faceplate by sliding the flanges of the faceplate into contact with the flanges of the backplate.

5. The modular wall lighting fixture as recited in claim 1, wherein the cap comprises a strip of material with a pair of arms extending laterally, one arm at each longitudinal end of the strip, whereby the arms overlap an upper and lower edge of the respective faceplates for securing the cap to the adjacent fixture modules.

6. The modular wall lighting fixture as recited in claim 5, wherein the arms each include a rolled edge for defining a stop that engages an edge of the respective flange on the faceplate upon positioning of the cap on the adjacent lighting fixtures.

7. The modular wall lighting fixture as recited in claim 1, further comprising a tubular connector attached to the adjacent pair of openings in the pair of fixture modules, for connecting the pair of fixture modules together and providing a tunnel through which the pair of electrical conductors pass.

8. A modular wall lighting fixture, comprising:

at least a pair of lighting fixture modules joined together in a spaced-apart relationship by a connector, each module comprising:

a backplate having a base with at least two opposing flanges extending laterally from the edges of the base and defining holes for receiving an end of the connector;

a faceplate having a face with at least two opposing flanges extending laterally from the edges thereof, the faceplate sized for being engaged to the backplate by sliding the faceplate flanges over an outer surface of the backplate flanges, the faceplate flanges each including a wire knockout for selective removal to form a notched opening for receiving the connector;

at least one socket connected to each fixture module for receiving a light bulb; and a pair of electrical conductors connected to the socket for communicating with a source of electricity;

the ends of the connector having a thread for engaging the holes of a first flange in the pair of backplates and a second flange in the second one of the pair of backplates, each end secured to the respective flange by a nut;

means for securing the baseplates to a wall; and a cap that covers a gap between the faceplates for hiding the connector extending between the pair of fixture modules, whereby the pair of electrical conductors from a first of the pair of the fixture modules extends into a second of the pair of the fixture modules through the connector.

9. A method of connecting wall lighting modules to define a lighting fixture, comprising:

securing at least one pair of backplates for lighting modules to a surface in a spaced-apart relationship to define a gap therebetween, each module comprising:

the backplate having a base with at least two opposing flanges extending laterally from the base;

a faceplate having a face with at least two opposing flanges extending laterally therefrom, the faceplate sized for being engaged to the backplate by sliding the faceplate flanges over the backplate flanges;

at least two opposing faceplate flanges each including a knockout for selective removal to form an opening for receiving a pair of electrical conductors therethrough;

at least one socket connected to each lighting module for receiving a light bulb; and the pair of electrical conductors connected to the socket for communicating with a source of electricity;

removing facing ones of the knockouts from a first one of the flanges on a first one of the faceplates and a second one of the flanges on a second one of the faceplates;

threading the pair of electrical conductors from a first of the pair of lighting modules to a second of the pair of lighting modules through the openings in the first and the second ones of the faceplate flanges;

sliding the faceplates into engagement with the backplates; and placing a cap on the faceplates to cover the gap between the pair of lighting modules.

10. The method as recited in claim 9, further comprising the step of connecting the pair of electrical conductors to a source of electricity.

11. The method as recited in claim 9, wherein securing comprises attaching the pair of backplates together with a threaded tubular connector engaged to holes in a pair of facing flanges in the pair of backplates, whereby the connector, being attached to the modules, forms a tunnel through which the pair of electrical conductors of the first lighting module pass into the second lighting module, and the holes in the flanges of the faceplates define notches for receiving the connector.

* * * * *